United States Patent [19]

Brand

[11] Patent Number: 4,625,961

[45] Date of Patent: Dec. 2, 1986

[54] TRANSPORTABLE HOME ENERGY TRAINING DEVICE AND SPROCKET

[76] Inventor: Dieter C. H. Brand, Bergstrasse 4, D-8201 Hohenthann, Fed. Rep. of Germany

[21] Appl. No.: 561,961

[22] Filed: Dec. 16, 1983

[30] Foreign Application Priority Data

Dec. 30, 1982 [DE] Fed. Rep. of Germany ..... 3248665

[51] Int. Cl.[4] ..... A63B 21/22

[52] U.S. Cl. ..... 272/132; 272/DIG. 5

[58] Field of Search ..... 272/140, 136, 72, 132, 272/131, 133, DIG. 4, DIG. 5; 128/25 R; 73/379

[56] References Cited

U.S. PATENT DOCUMENTS

| | | | |
|---|---|---|---|
| 518,967 | 5/1894 | Poole | 272/132 |
| 1,974,445 | 9/1934 | Calleson | 272/72 |
| 2,512,911 | 6/1950 | Benice | 272/72 |
| 3,896,672 | 7/1975 | Henson et al. | 272/DIG. 5 X |
| 3,903,613 | 9/1975 | Bisberg | 73/379 X |
| 3,977,676 | 8/1976 | Geisselbrecht | 272/140 X |
| 3,995,853 | 12/1976 | Deluty | 272/132 |
| 4,010,948 | 3/1977 | Deluty | 272/140 X |
| 4,114,874 | 9/1978 | Mattila | 272/132 X |

FOREIGN PATENT DOCUMENTS

| | | | |
|---|---|---|---|
| 2274322 | 1/1976 | France | 272/132 |

*Primary Examiner*—Richard J. Apley
*Assistant Examiner*—Robert W. Bahr
*Attorney, Agent, or Firm*—Paul L. Sjoquist

[57] ABSTRACT

A transportable home energy training device having a supply drum with a tension element wound thereabout, the supply drum being rotatably coupled to a braking member, the braking member associated with a number of braking devices which may be selectively engaged against the braking member by a brake setting control, and a variable drive gear coupled to the brake setting control and an indicating wheel engageable by the variable drive gear for providing an indication of total work corresponding to the number of braking devices which are engaged against the braking member.

11 Claims, 3 Drawing Figures

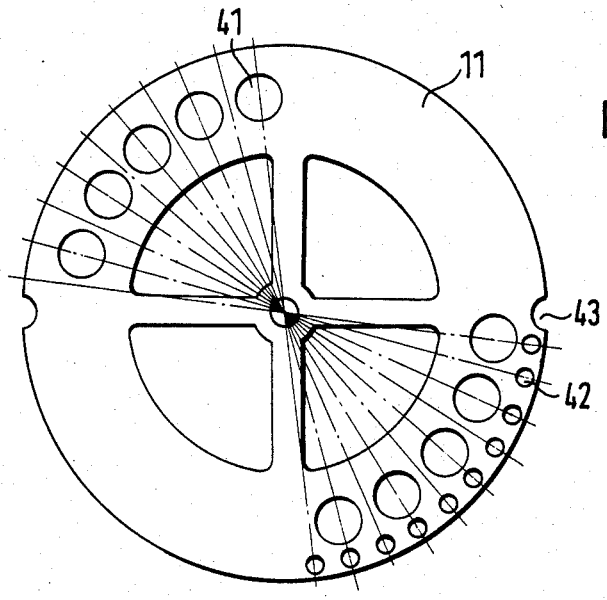
FIG. 2
FIG. 3
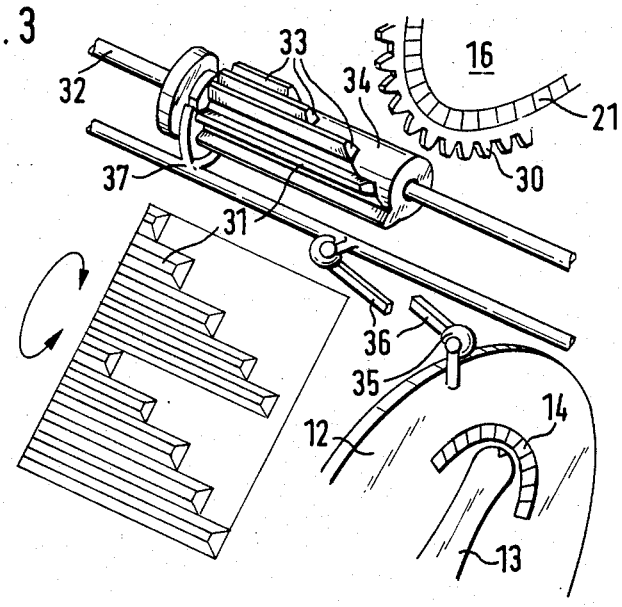

TRANSPORTABLE HOME ENERGY TRAINING DEVICE AND SPROCKET

BACKGROUND OF THE INVENTION

The invention relates to a transportable home energy training device with a housing, at least one tension element capable of being unwound from a supply drum and capable of being rewound again thereon, and a braking mechanism for generating a preestablishable braking force, by means of braking force setting means, directed against unwinding of the tension element.

A device of this type is known from German Pat. No. 24 24 965. In the case of the known device, further provided is a return spring for automatic (self-actuated) rewinding of the tension element when the braking force is released. The braking mechanism here consists of a steel band and individual lamellae capable of being pressed against the steel band. Here, the number of the lamellae determines—besides the pressure exerted on each of them—the total braking force acting against the unwinding of the tension element. In the case of the known device, the lamellae consist of an elastic material with good braking property and resistance to abrasion. They are capable of being pressed individually against the steel band by means of pushbuttons. The steel band itself is guided over a sliding platform that serves as an abutment for the steel band, respectively the lamellae. As a consequence of winding the tension element onto a supply drum, the known device species has the advantage of enabling long training strokes, and, therefore, the previously known limitation of the working stroke of rubber tension/spiral spring and/or bending devices is no longer present. Moreover, the known device species has the advantage that the rebound effect has the consequence of conversion into heat of the work performed against the device, and the danger of injury resulting therefrom no longer occurs and/or is not present. To be particularly emphasized, however, in the case of the device of the known species, is the possibility of being able to increase and/or decrease, in step fashion and in reproduceable manner by means of an appropriate switching-in of lamellae, the total braking force acting against an unwinding of the tension element. However, with the device of the known species, it is not possible to measure the work performed against the device by the person training or even extrapolate the work performed during several training strokes.

Also further known from German Pat. Nos. 14 78 043 and 19 62 658 are home sports devices with which the work performed against the home sports device is converted into heat, therefore is not stored in the form of potential energy. However, with these devices also, the work actually performed by drawing back the tension element cannot be measured.

For explanation of the technical background from whence the invention stems, let reference be additionally made to the German OS* Nos. 30 31 292 and 30 42 520, as well as to U.S. Pat. Nos. 4,082,267 and 3,929,331. By means of these devices, important parameters for the person training, for the purpose of determining his capacity for exercise, can indeed be read off, however, not the work that he performs.

*OS=Offenlegungsschrift=Laid open print, published patent application (specification) examined only as to obvious defects but not as to patentability.

The task underlying the invention is now to develop further the device of this species such that the work exerted by the person training during the training strokes is indicated.

In accordance with the invention, this task is resolved by the fact that the device of this species is additionally equipped with an indicating mechanism for continuous indication of the total work performed against the energy training device, a coupling mechanism for establishing a driving connection between the tension element and the indicating mechanism when unwinding, and for releasing this connection when rewinding the tension element, and a control mechanism capable of being coupled with the braking force setting means for braking force-dependent alteration of response sensitivity of the indicating mechanism to the segment unwound with the tension element. The task underlying the invention is actually basically known from the German AS* No. 25 40 493, respectively, U.S. Pat. No. 4,112,928 corresponding thereto, along with U.S. Pat. No. 3,511,097. However, in the case of the known devices, we are not dealing with transportable home energy training devices, but rather with so-called ergometers. In particular, in the case of these devices, we are not dealing with energy training devices of a species capable of being actuated in manner of an expander.

*AS=Auslegeschrift=Patent application published for opposition, printed specification of the application after examination.

Indeed, the known ergometers from the last-mentioned publications also display, each in turn, an indicating mechanism for continuous indication of the total work performed against the energy training device; not, however, a coupling mechanism for the alternating establishment of a driving connection between the tension element and the indicating mechanism when unwinding, as well as for releasing this connection when rewinding the tension element and/or a control mechanism that is capable of being coupled with the braking force setting means for the braking force-dependent change of response sensitivity of the indicating mechanism to the segment unwound with the tension element.

The coupling apparatus here certainly illustrates that only the measured work performed during a training stroke and the amounts of work performed during several training strokes can be added together. The capability of coupling between the braking force setting and the control mechanism enables an automatic adjustment of the indicating mechanism to the braking force that is set at any given time.

Overall, the device in accordance with the invention enables retaining and extrapolating the results of training work accomplished from force×path, synchronously with the set braking force values.

SUMMARY OF THE INVENTION

In accordance with a preferred form of embodiment of the invention, the indicating mechanism is structured as a mechanically driveable measuring disc and capable of being joined mechanically with the supply drum via the coupling mechanism (i.e. joined when unwinding and released when rewinding). The control mechanism for the braking force-dependent change of response sensitivity of the indicating mechanism is, here, embodied as a mechanism for the braking force-dependent settable changing of the mechanical translation ratio between the supply drum and the measuring disc. Realized in this fashion, with the simplest mechanical means, is a braking force-dependent change of the response sensitivity of the indicating mechanism to the segment that is unwound with the tension element. Supplying the training device in accordance with the invention with electrical energy—as is required in the case of known ergometers—is, accordingly, not necessary.

In further development of the precedingly described, preferred form of embodiment, connected between the braking force setting means and the control mechanism is a coupling apparatus structured as a connecting rod, and constructed such that actuation of the braking force setting means automatically leads to a corresponding change of the previously mentioned mechanical translation ratio. Accordingly, a modification of the braking force leads automatically to a corresponding new adjustment of the indicating mechanism.

Preferentially, the measuring disc is structured as a rotatable recording disc with a toothed rim along the periphery of the disc, with the control mechanism displaying a sprocket corresponding to the toothed rim, which is arranged on a driving axle capable of being joined with the supply drum. For the purpose of changing the translation ratio between the sprocket and the toothed rim, the sprocket preferentially consists, essentially, of a cylinder form core and teeth of different lengths arranged next to each other thereon, with the different length teeth being arranged in the manner of the arrangement of organ pipes in an organ. Additionally, the recording disc and the sprocket are axially displaceable relative to one another and arranged in meshing fashion with each other in the operating position. With this form of embodiment, if only the longest tooth of the sprocket meshes with the toothed rim, it then operates almost like a cam drive, because the measuring disc will be turned further by one tooth of the toothed rim with one complete revolution of the sprocket. On the other hand, if the shortest tooth also meshes with the toothed rim or, in other words, if all teeth of the sprocket mesh (because of their organ pipe-like arrangement) with the toothed rim, then the recording disc will be turned, per full revolution of the sprocket, by as many toothed rim teeth as there are teeth available on the sprocket.

Instead of the previously mentioned embodiment of the control mechanism for braking force-dependent changing of the translation ratio between control mechanism and toothed rim, capable of being provided, in place of the toothed rim, is also a step cylinder that can be brought into frictional engagement with the measuring disc. Here, that position of the step cylinder, in which the cylinder step displaying the smallest diameter is in frictional engagement with the recording disc, corresponds to that position of the aforementioned sprocket in which only the longest tooth meshes with the toothed rim. The same applies for the position of the step cylinder in which the cylinder step displaying the largest diameter is in frictional engagement with the recording disc.

Preferentially, the braking mechanism displays several, separately settable braking elements that are additive relative to their braking force. Achieved in this fashion are the advantages resulting from the use of individual braking elements, known from the initially mentioned species German Pat. No. 24 24 965.

However, in contrast to the known device from German Pat. No. 24 24 965, the braking mechanism displays a separate brake disc that is capable of being joined in driving fashion, in the unwinding direction, with the supply drum. Accordingly, the braking elements do not engage directly to the tension element, so that there needs be no compromise between the properties of a brake drum and those of the tension element.

In further development of the last-mentioned, preferred form of embodiment of the invention, the braking elements are structured pin-fashion and are guided in axially displaceable fashion into braking element accommodating borings in a braking element mounting support drum aligned toward the brake disc. Here, the braking element mounting support drum is structured cylindrically, arranged concentrically to the brake disc and journaled statically relative to the housing. For the purpose of switching in the braking elements step-fashion against the brake disc, and/or for releasing same from the brake disc, the braking force setting means preferentially display a braking step setting disc which, relative to the braking element mounting support drum, is rotatably arranged on the side facing away from the brake disc and is structured in such fashion that, when rotating, the braking elements are pressed individually one after the other against the brake disc, respectively, in the case of corresponding return rotation, are again released individually and one after the other from the brake disc.

Here, all braking elements are preferentially equally long, and the braking step setting disc is equipped, within a first circle sector, with a projecting shoulder aligned toward the braking elements. In order that each braking element exert an equal braking force, the shoulder has a constant height.

A centrally symmetric brake loading of the brake disc can be realized by preferentially arranging the braking elements into diametrally opposing sectors of the braking element mounting support drum. In order also to additionally guarantee individual control of the braking elements with this arrangement, these latter (braking elements) are arranged according to the following pattern: one braking element of the one sector lies diametrally opposite to the intermediate space between two braking elements of the other sector. The braking step setting disc in the case of this form of embodiment displays two shoulders corresponding to these sectors—again of constant height. A limitation of the aforementioned shoulder to a comparably narrow circular space within the braking step setting disc can be achieved by arranging the braking element accommodating borings such that the midpoint of the braking elements guided thereinto are constantly the same distance from the braking element mounting support drum axle, hence lying on a circle that is centric to the aforementioned axle. Further guidance of the braking elements is achieved by constructing a ring groove in the braking step setting disc that accommodates the braking elements. The projecting shoulders are then formed out in this ring groove.

The preferred embodiment of the braking elements as springy pins prevents a material abrasion occasioned alteration of the braking force in the operating position of the braking pins.

In particular preference, the device in accordance with the invention displays only a single coupling, for example a ratchet coupling for driving connection of the brake disc on one side, and the indicating mechanism with the supply drum on the other side, with this coupling being configured such that, in the unwinding direction, it engages the supply drum and in the rewinding direction releases the supply drum.

In accordance with another preferred form of embodiment, the indicating mechanism, the supply drum and a drive disc are each arranged in rotatable fashion on a common first axle fixed to the housing, with the supply drum being joined with the driving disc by means of a ratchet coupling. Here, moreover, the brake disc, the braking element mounting support drum and the braking step setting disc are likewise arranged on a common second axle, parallel to the first mentioned axle, with the brake disc being joined in driving fashion with the drive disc. The driving axle that is joined in driving fashion with the control means is here arranged between and parallel to the first and second axles, and also joined in driving fashion with the driving disc.

As is known from German Pat. No. 24 24 965, the device in accordance with the invention based on a preferred embodiment, also displays a return spring for automatic rewinding of the tension element.

The invention also relates to a sprocket that is particularly suited for use in the device in accordance with the invention—here for the smooth changing of the translation ratio between two gears. The toothed rim of the sprocket in accordance with the invention here consists essentially of several teeth of different lengths arranged next to each other in the direction of the sprocket axle, which are preferentially arranged in an ascending and/or descending order—referenced to the tooth lengths—in the manner of organ pipes.

DESCRIPTION OF THE DRAWINGS

The invention will be described in more detail in the following with the aid of an example of embodiment, with reference to the accompanying schematic drawings. Shown in the drawings are:

FIG. 2 the braking element mounting support drum used in the example of embodiment illustrated, in a top view, and FIG. 3 a sketch of the principle for braking force-dependent change of response sensitivity of the recording disc to the path traveled by the tension element.

DESCRIPTION OF THE PREFERRED EMBODIMENT

Figure 1:
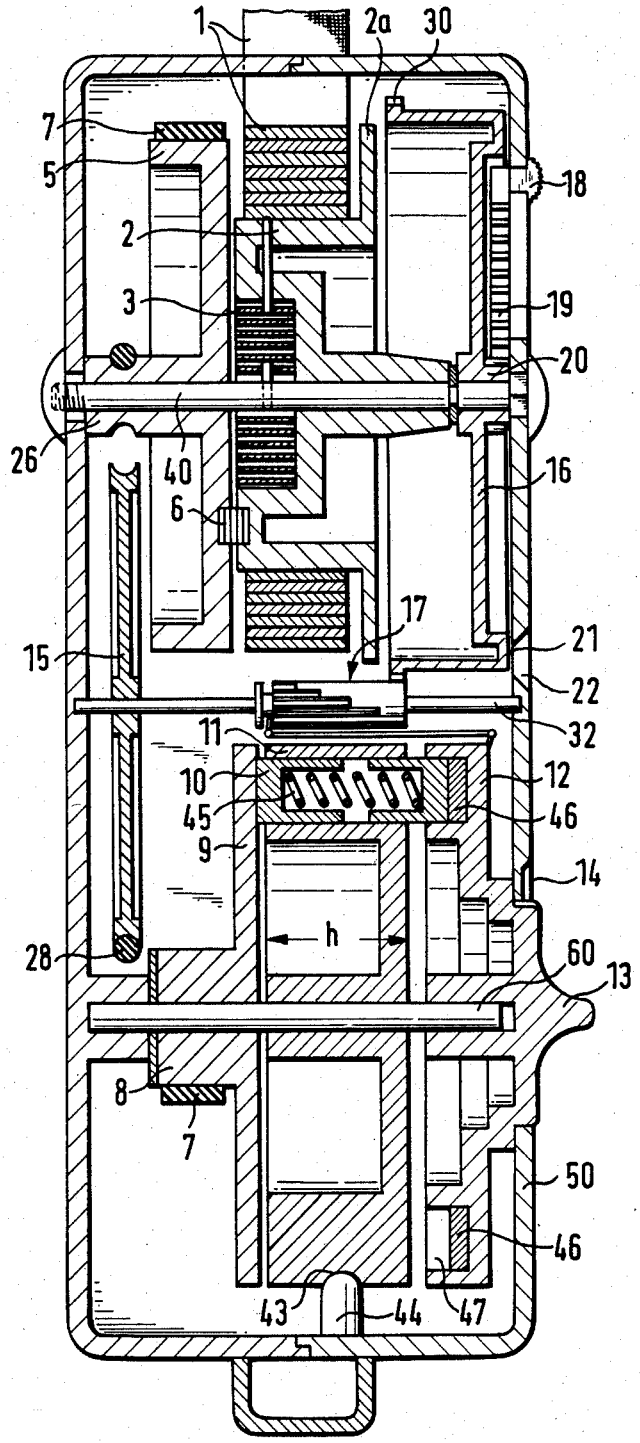
FIG. 1 a schematic cut illustration through an example of embodiment of the invention.

The energy training device in accordance with the invention can be actuated by means of at least one tension element, in the manner of an expander. However, in contrast to the expander, it does not store the work performed by the person training during one training stroke and/or pull in the form of potential energy, rather converting the work into heat and leading it out of the device.

The greatly simplified example of embodiment illustrated schematically in FIGS. 1 to 3 displays an essentially parallelepiped, closed housing 50, in which are located the following described mechanisms. The device is equipped with two grips or loops—only one grip is illustrated. The grip that is not illustrated is joined with the end of a band-like tension element 1 capable of being unwound from a supply drum 2, led out from the housing 50. The grip that is illustrated is disposed on the outside wall of the housing.

Instead of the one tension element 1, two tension elements can also be wound onto a supply drum in the same direction and be pulled out at diametrally opposed ends of the supply drum and led out from the housing 50. Instead of one drum, two supply drums can also be provided and be capable of being joined in driving fashion with two or one common braking mechanism yet to be described.

The grip and/or loop arranged on the tension element 1 and/or housing 50 are to be configured such that they are possibly also interchangeable with other training energy gripping elements, that are suited as well for use with both hands, both feet, a combination of hands and feet or other body parts in need of training. A static use of the energy training device is enabled by one-sided latching to a support on a door, wall, on a step wall or similar, through means of an appropriate force grip element.

In accordance with FIG. 1, the example of embodiment displays three axles 32, 40 and 60, arranged parallel to one another, at some distance apart and next to each other in the longitudinal direction of the housing. All three axles are supported in the oppositely lying housing walls. Rotatably journaled on the first, stiff axle 40 is the supply drum 2. Under action of training pulling force, tension element 1 is unwound from the supply drum 2. The end of the tension element 1 located inside housing 50 is firmly joined with the supply drum 2, hence rotates this latter in the unwinding direction with a training pulling force. The supply drum 2 is further furnished with a mechanism for generating a rewinding force, in order to assure automatic rewinding of the tension element 1 onto the supply drum 2. Provided for this purpose is a torsion spring 3, which is joined, under biasing tension, at its one end with the supply drum 2 and firmly joined with its other end with the first axle 40. Rotatably journaled on the first axle 40, concentrically to and next to the supply drum 2, is a drive disc 5. The drive disc 5 is joined with the supply drum 2 via a (claw-shaped) ratchet coupling 6. The ratchet coupling is positioned so that it transfers a rotation of the supply drum 2 in the unwinding direction in rotation-stiff fashion to the drive disc 5, in the case of rewinding, on the other hand, releases the drive disc 5 and the supply drum 2 from one another. These types of ratchet couplings are known from ratchet-type wrenches, starter mechanisms for motorized lawnmowers, bicycle freewheeling or similar mechanisms.

The drive disc 5 can be embodied as a chain wheel, gear pulley wheel, V-belt pulley or the like. It is joined in driving fashion with the hub 8 of a brake disc 9 over an appropriate force transfer element, for example a gear chain, a gear belt, or a cone belt, called in the following drive belt 7. The brake disc hub 8 is structured corresponding to the configuration of the drive belt 7, hence, for example, as a chain wheel, gear belt disc or V-belt pulley. The brake disc 9 is supported on the second axle 60. Likewise rotatably journaled on this second axle 60, concentric to and next to the brake disc 9, is a braking element mounting support drum 11. The braking element mounting support drum 11 is illustrated in more detail in FIG. 2. The braking element mounting support drum 11 displays, in the region of the outer rim, brake pin accommodating borings 41 that are guided through the braking element mounting support drum 11, parallel to the second axle 60, and their midpoints lie inside two quadrant-shaped segments of a circle that is centric to the second axle 60. Arranged in axially displaceable fashion in the braking pin accommodating borings 41 are cylinder form brake pins 10. The height h of the braking element mounting support drum 11 is less than the length of the brake pins 10. These latter accordingly project out to both sides from the brake pin accommodating borings 41. The radius of the segment of circle formed by the midpoints of the brake pin accommodating borings 41 is smaller than that of the brake disc 9, so that the brake pins 10 can be brought in contact against the brake disc 9.

For achieving as centrally symmetric as possible loading of the brake disc 9 and therewith the entire braking mechanism, the brake pin accommodating borings 41 are arranged inside the two quadrants shown in FIG. 2 such that two each brake pin accommodating borings 41 lie, inasmuch as possible, diametrally opposite to one another—taking into account the yet to be described individual control of the brake pins 10. Locking of the braking element mounting support disc 11 is guaranteed by engagement of arresting grooves 43 in arresting pins 44 attached to housing 50. Instead of the arresting of the braking element mounting support drum 11 illustrated, this latter can also be rigidly joined with the second axle 60 and the second axle 60 can in turn be joined in rigid fashion with the housing.

The ends of the brake pins 10 projecting out from the braking element mounting support drum 11 facing away from the brake disc 9 are guided in a ring groove 47. The ring groove 47 is formed out in a braking step setting disc 12 arranged rotatably on the second axle 60, concentrically to and next to the braking element mounting support drum 11. The braking step setting disc 12 can rotate against the braking element mounting support drum 11 by means of a rotary switch 13 projecting out from housing 50.

For the purpose of individual control of the brake pins 10, in the example of embodiment illustrated, these are all equally long. Corresponding thereto, constructed in the ring groove 47 are two shoulder sections 46 of constant height projecting in the direction of the brake pins 10. The two shoulder sections 46 lie within two quadrants that are diametrally opposed to one another—corresponding to the arrangement of the brake pin accommodating borings 41 inside the quadrants of the braking element mounting support drum 11 lying diametrally opposite each other. Furthermore, for the purpose of the above-mentioned individual control, the brake pin accommodating borings 41 are arranged such that the midpoint of each brake pin accommodating boring 41 within the one quadrant lies diametrally opposed to the middle of the distance between two brake pin accommodating borings 41 of the other quadrant arranged immediately next to one another. Corresponding to this offset arrangement of the brake pin accommodating borings 41, the projecting shoulders 46 in both ring groove segments are arranged offset against one another. The ring groove accordingly displays, at a distance of approximately 90°, alternately in turn, because of the shoulder 46, a relatively flat and—because of lack of the shoulder 46—a relatively deep area. Because of the offset arrangement of the shoulders 46 and the brake pin accommodating borings 41, respectively the brake pins 10 disposed therein, rotation of the braking step setting disc 12 leads to the individual brake pins being pressed sidewardly one after the other against the brake disc 9. After rotation of the brake step setting disc 12 by 90°, all brake pins 10 exert a braking force against the brake disc 9. Since the shoulder 46 has a constant height, the brake pins being all of equal length and, additionally, also further display equal diameters, each brake pin 10 exerts the same braking force on the brake disc 9 in the operating position. The total braking force exerted is, accordingly, equal to the sum of the individual braking forces exerted by the brake pins 10. By stepwise increase and/or decrease in the number of brake pins 10 pressed against the brake disc 9, the braking force can be increased and/or decreased stepwise in reproduceable fashion.

In order to render engagement between the shoulder 46 and the brake pins 10 easier, shoulder 46 is slanted and/or shifted, in the direction of rotation, at its forward rim. Possibly occurring abrasion phenomena on the adjacent surfaces of the brake pins 10 in the operating position, with the consequence of possible reduction of the braking force, is countered by a telescopic embodiment of the brake pins 10. For this purpose, the brake pins 10 consist essentially of two trough-shaped parts arranged in mirror image to each other and a spiral spring 45 disposed between them. A braking step setting stop can be realized by the fact that, in accordance with FIG. 2, the braking element mounting support drum 11 is provided, on its surface facing toward the braking step setting disc 12, with indexing points 42 for engagement of the ball notches arranged on the braking step setting disc 12. Here, exactly one indexing point is associated to exactly one braking pin accommodating boring 41. Since the indexing points 42 in accordance with FIG. 2 are all arranged in one and the same quadrant, the interval of the angle between two immediately adjacent indexing points 42 is equal to the angle of deviation of 180° between two of the braking pin accommodating borings 41 corresponding to one another in the quadrant sectors lying diametrally opposed to one another. The number of brake pins 10 pressed against the brake disc 9 at any one time, or a magnitude derived therefrom for reproducing the braking step connected in at any given time can be read from the outside on a setting scale 14.

Basically, it would also be possible to reject the individual control of the brake pins 10 that has been described and, instead of this, to press all brake pins 10 simultaneously against the brake disc 9. In this case, an increase in braking force would be executed by an increase of the contacting pressure. Should use be made of a braking step setting disc 12 corresponding to the braking force setting disc described, a shoulder 46 would not be required in such event.

Rotatably journaled on the first axle 40, concentric to and next to the supply drum 2, is a recording disc 16 with a ring-shaped scale 21 arranged in its edge region. The scale 21 can be read through a viewing window 22 provided in the housing wall. The recording disc 16 is located on the side of the supply drum 2 that is facing away from the drive disc 5 and is structured in the shape of a trough. On its free trough edge, it is equipped with a toothed rim 30. The toothed rim 30 can—like is yet to be explained further on—be brought into meshing engagement with a gear drive 17 that is yet to be described.

The gear drive 17 consists essentially of a cylinder form structured sprocket 31 that is arranged in axially displaceable fashion on the already-mentioned axle and/or drive axle 32.

According to FIG. 3, the sprocket 31 consists essentially of a cylinder form core 34 and different length teeth 33 arranged next to each other thereon in the peripheral direction. Overall, the teeth 33 are arranged on the core 34 in the manner of the arrangement of the organ pipes in the case of an organ. The number of different length teeth 33 is equal to the number of braking pin accommodating borings 41 in the braking element mounting support drum 11, respectively to the number of brake pins 10 provided. For achieving as uniform as possible driving of the recording disc 16—corresponding to the arrangement of the brake pin accommodating borings 41 within two oppositely lying quadrants on the braking element mounting support drum 11—the teeth 33 are arranged next to each other on the cylinder form core 34 in two tooth groups of increasing length. This is illustrated by the development of the teeth 33 on a plane, illustrated in FIG. 3. The 180° deviation angle between a tooth 33 and the next longer tooth 33 is equal to the previously described interval of angle between two indexing points 42. The arrangement of the teeth 33 on the core 34 accordingly corresponds to the arrangement of the braking pin accommodating borings 41 in the braking element mounting support drum 11. With appropriate axial displacement of the sprocket 31 along the driving axle 32, the arrangement of the teeth 33 that has been explained accordingly enables a stepwise increasing of the translation ratio between the gear drive 17 and the recording disc 16.

Axial displacement of the sprocket 31 along the driving axle 42 is carried out through means of a connecting rod joined with the braking step setting disc 12 and the one end of the sprocket 31 (FIG. 3). The connecting rod is laid out for conversion of a rotary motion of the braking step setting disc 12 into an axial displacement of the sprocket 31. For this purpose, the braking step setting disc 12 is joined with a ball joint pivot lever 35, this latter, in turn, with a pendulum connecting rod 36 and this latter, in turn, with a claw connecting rod 37 engaging at one end of the axial sprocket 31. Self-understood, any other suitable mechanism for conversion of the rotary motion of the braking step setting disc 12 into an axial displacement of the sprocket 31 can also be provided. In any event, the difference in length between a tooth 33 and its next longer tooth 33 is equal to that axial displacement of the sprocket 31 that corresponds to the angle of rotation of the braking step setting disc 42, between the two adjacent brake pins 10 corresponding to these teeth 33. As a function of whatever mechanism used for conversion of the rotary motion of the braking step setting disc 12 into an axial displacement of the sprocket 31, the axial displacements associated to the continuously equal rotation angle steps can be of different lengths, for example be dependent upon the total angle of rotation in manner of a trigonometric function.

Depending upon the position of the sprocket 31 on the driving axle 32, only one tooth 33 meshes with the toothed rim 30 (greatest possible speed reduction), all teeth 33 mesh with the toothed rim 30 (greatest possible increase in speed) or an intermediately lying number of teeth 33 mesh with the toothed rim 30. Here, the greatest possible reduction in speed corresponds to engagement of only one brake pin 10 with the brake disc 9, and the greatest possible increase in speed to engagement of all brake pins 10 with the brake disc 9.

Rigidly joined with the drive axle 32 is a speed reduction disc 15 and this latter is joined in driving fashion via another drive belt 28 with the hub of the drive disc 5.

Achieved by the forced coupling between the rotary motion of the braking step setting disc 12 and the axial displacement of the sprocket 31 is that, with each additional brake pin 10, one additional tooth 33 of the sprocket 31 comes into meshing engagement with the toothed rim 30 of the recording disc 16. Accordingly, correspondingly synchronously with the change of braking force, also changing is the rotational speed of the recording disc 16 and, therewith, the transmit speed of the scale 21 through the viewing window 22.

The gear drive 17 could basically also be realized in another form, for example by having an axle-drive bevel wheel serve as a teeth and/or engagement finger carrier, with the teeth being patterned in different effective lengths, running from the center of the axle-drive bevel wheel to the outer edge. This axle-drive bevel wheel, which must be constructed as a driving wheel, then transfers the effective tooth impulse to an axially displaceable, corresponding sprocket, which, in its turn, functions as a drive for the recording disc 16.

In the case of the example of embodiment illustrated, the recording disc 16 can be returned to the initial position, hence to the ZERO position, by equipping it with a pinion 20, the pinion 20 meshing with a gear rack 19 and the gear rack 19 capable of being displaced via a slide 18 guided in a slide block.

Basically, the brake disc 9 could also be arranged on the same axle as the supply drum 2. This solution would have the advantage of being able to save on a separate drive element for the brake disc. For this purpose, however, a greater structural width would have to be taken into account. For example, the free edge 2a of the supply drum 2 illustrated in FIG. 1 could serve as a brake disc.

In the case of the example of embodiment illustrated, because of the ratchet coupling 6, the braking force applied by the brake pins 10 against the brake disc 9 acts only against an unwinding of the tension element 1 from the supply drum 2. Likewise because of the ratchet coupling, only that segment of the tension element 1 travels over in the unwinding direction, hence the training stroke is transformed into a rotary motion of the sprocket 31. The total angle of rotation and/or the total number of revolutions of the sprocket 31 here correspond to the total lengths of the training stroke(s). The number of teeth 33 meshing with the recording disc/toothed rim 30 with one complete revolution of the sprocket 31 corresponds to the total number of brake pins 10 pressed against the brake disc 9, in other words, therefore, to the braking force. Accordingly, the recording disc 16 shows the product of path × force, equal therefore to the total work performed by the person training against the device.

I claim:

1. A transportable home energy training device comprising (a) housing;

(b) a rotatable supply drum and at least one tension element in said housing, said tension element being capable of being unwound from said supply drum and capable of being rewound again thereon;

(c) a braking member in said housing, coupled to said drum, and a plurality of frictional braking devices capable of being engaged against said braking member, and means for selectively engaging one or more of said braking devices against said braking member;

(d) a variable drive gear in said housing and rotatably coupled to said supply drum;

(f) positioning means for positioning said variable drive gear to a number of gear drive positions corresponding to the number of braking devices engaged against said braking disk, said positioning means being coupled between said variable drive gear and said means for selectively engaging one or more of said braking devices, whereby the geared engagement of said indicating wheel is selectively adjusted corresponding to the frictional braking devices engaged against said braking member.

2. The apparatus of claim 1, wherein said means for positioning said variable drive gear further comprises means for shifting said drive gear along an axis.

3. The apparatus of claim 2, wherein said means for shifting said drive gear along an axis further comprises a control rod engageable between said drive gear and said means for selectively engaging one or more of said braking devices.

4. The apparatus of claim 3, wherein said variable drive gear further comprises a sprocket having a plurality of different length teeth arranged next to one another in organ pipe fashion about said axis.

5. The apparatus of claim 1, wherein said indicating wheel further comprises a disk having teeth about its circumference.

6. The apparatus of claim 5, wherein said variable drive gear further comprises a sprocket having a plurality of different length teeth arranged next to one another in organ pipe fashion about said axis, engageable against said disk circumferential teeth.

7. The apparatus of claim 1, wherein said plurality of frictional braking devices each further comprise a cylindrical segment having a circular end surface frictionally engageable against said braking member.

8. The apparatus of claim 1, further comprising a ratchet drive coupling between said supply drum and said braking member, said ratchet drive coupling being engaged in the tension element unwinding direction and disengaged in the tension element winding direction.

9. The apparatus of claim 7, further comprising a wheel mounted adjacent said braking member, said wheel having a plurality of bores therethrough and each of said bores containing one of said cylindrical segments.

10. The apparatus of claim 9, further comprising a brake setting disk mounted adjacent said wheel, said brake setting disk having a contoured surface facing said wheel and engageable against said cylindrical segments, said wheel comprising part of said means for selectively engaging one or more of said braking devices.

11. The apparatus of claim 10, wherein said cylindrical segments each further comprise a pair of cylindrical ends spaced apart by a compression spring.

* * * * *